United States Patent [19]

Girouard

[11] Patent Number: 4,790,032

[45] Date of Patent: Dec. 13, 1988

[54] WOMAN'S SLIP WITH V-SHAPED CUTOUTS

[76] Inventor: Ester D. Girouard, P.O. Box 726, Gautier, Miss. 39553

[21] Appl. No.: 97,262

[22] Filed: Sep. 17, 1987

Related U.S. Application Data

[63] Continuation of Ser. No. 881,798, Jul. 3, 1986.

[51] Int. Cl.[4] ..... A41B 9/00

[52] U.S. Cl. ..... 2/109; 2/72; 2/211

[58] Field of Search ..... 2/109, 73, 212, 400, 2/406, 407, 211, 70, 71, 72

[56] References Cited

U.S. PATENT DOCUMENTS

| | | | |
|---|---|---|---|
| 1,796,152 | 3/1931 | Holme | 2/71 |
| 1,966,861 | 7/1934 | Johnston | 2/211 |
| 2,080,814 | 5/1937 | Foltz | 2/212 |
| 2,286,938 | 6/1942 | Stegman | 2/73 |
| 2,358,113 | 9/1944 | Solomon | 2/212 |
| 2,440,868 | 5/1948 | Mintzes | 2/212 |

FOREIGN PATENT DOCUMENTS

| | | | |
|---|---|---|---|
| 1000939 | 2/1952 | France | 2/212 |
| 1075443 | 10/1954 | France | 2/72 |
| 1435990 | 12/1964 | German Democratic Rep. | 2/211 |
| 5911344 | 8/1947 | United Kingdom | 2/73 |

OTHER PUBLICATIONS

Velcro Digest, #6, Self Adhering Nylon Tapes, Journal of AMA, vol. 168, No. 7, 10/1958, Gershman.

*Primary Examiner*—Louis K. Rimrodt
*Assistant Examiner*—J. L. Olds
*Attorney, Agent, or Firm*—Milton S. Gerstein

[57] ABSTRACT

A woman's slip is provided with a plurality of spaced-apart V-shaped openings along the lower hem portion of the slip. Each V-shaped opening has associated with it a pair of fabric closure-pieces for selectively and alternatively closing of the V-shaped opening or exposing the V-shaped opening, so that the slip may be used with a slitted outergarment, such as a skirt or dress, and alternatively used also with non-slitted outergarments. Each piece is integrally connected with a portion of the slip, and is capable of swinging movement along one side thereof relative to the slip. A plurality of mating female and male fastening elements keep each of the fabric closure-pieces in each of their two possible positions. The V-shaped openings are closed off by the fabric closure-pieces so that the V-shaped openings are not visible when wearing a non-slitted outergarment that is also somewhat sheer, so that the slip looks aesthetically pleasing.

10 Claims, 1 Drawing Sheet

WOMAN'S SLIP WITH V-SHAPED CUTOUTS

This is a continuation of co-pending application Ser. No. 881,798 filed on July 3, 1986.

BACKGROUND OF THE INVENTION

The present invention is directed to a whole or half slip for use by women such that the slip may be used under skirts or dresses with or without slits along the sides thereof. Dresses and skirts often have an elongated slit starting at the lower hem portion of the dress or skirt and extending upwardly therefrom, which slit allows for easier movement of the legs, as well as providing aesthetic value, depending upon the fashion-trends prevalent. If a women wears such a skirt or dress having a slit therein, then she must also wear an undergarment, such as a slip or half-slip also having a slit formed therein to correspond with the slit in the overgarment, so that the slip is not visible under the overgarment. However, even when such an undergarment is worn with a slit, ofttimes the slip may still become visible at times, depending upon the movements of the wearer, and owing to the fact that the slip in the slip is generally not a cut-out, so that the separation of the slit of the skirt will expose the slip underneath, since the movement of the slip does not precisely match the movement of the skirt or dress thereover.

SUMMARY OF THE INVENTION

It is the primary objective of the present invention to provide a slip or half-slip for use with a dress or skirt that has a slit formed therein, while at the same time allowing for the use of the very same slip or half-slip with a dress or skirt that does not have a slit therein.

It is another objective of the present invention to provide for such a slip or half-slip having four V-shaped cut-outs spaced 90 degrees apart about the lower portion of the slip in order to allow for use of a full slip with any kind of skirt or dress that may have its slit formed either in the front, rear, or on either side thereof.

It is still another objective of the present invention to provide a half-slip or full slip with V-shaped cut-outs that may be closed off by a pair of substantially-triangular pieces of lace when the overgarment does not include a slit at all, so that the benefits of a slip without any slits or cut-outs therein may be enjoyed, to allow for the advantages of the additional material of the slip to be utilized.

It is yet another objective of the present invention to provide such a slip or half-slip with V-shaped cut-outs that allow each cut-out to be easily formed or closed off by the provision of male and female fastening elements.

Toward these and other ends, the slip of the present invention is, in the preferred embodiment, provided with four V-shaped cut-outs spaced 90 degrees apart in the angular system about the lower portion of the slip originating at the lower hem portion thereof. Each V-shaped cut-out has associated with it a pair of substantially triangular pieces that when attached together close off the cut-out, and when separate from each other and fastened to the undersurface of the slip allow for the V-shaped cut-out to be exposed, for use with a skirt or dress having a slit therein. One triangular piece is provided with an inwardly-facing male fastening element which cooperates with a female fastening element in the under-surface of the slip spaced from the V-shaped cut-out in a direction away from the other triangular piece. The other triangular piece is provided only with a male fastening element on its undersurface for cooperating with another female fastening element on the under-surface of the slip in a direction away from the first triangular piece. The male fastening element of the other triangular piece also cooperates with a female fastening element on the outer surface with a female fastening element on the outer surface of the one triangular piece, so that when the two pieces are positioned for closing off the V-shaped opening, the male fastening element of the other piece mates with the female fastening element of the one piece for closing off the cut-out. In this closure position of the two triangular pieces, the other triangular piece overlaps the one triangular piece, so that when viewed from the outside, one only sees a substantially continuous piece of fabric, where no fastening elements may be seen. Each piece is simply pivoted about a line forming a side of the triangle thereof in order to open up the V-shaped cut-out, or to close it off,with a female fastening element attached to the under-surface of the slip holding each piece in its retracted, folded-back position.

BRIEF DESCRIPTION OF THE DRAWING

The invention will be more readily understood with reference to the accompanying drawing, wherein.

DETAILED DESCRIPTION OF THE INVENTION

Figure 1:
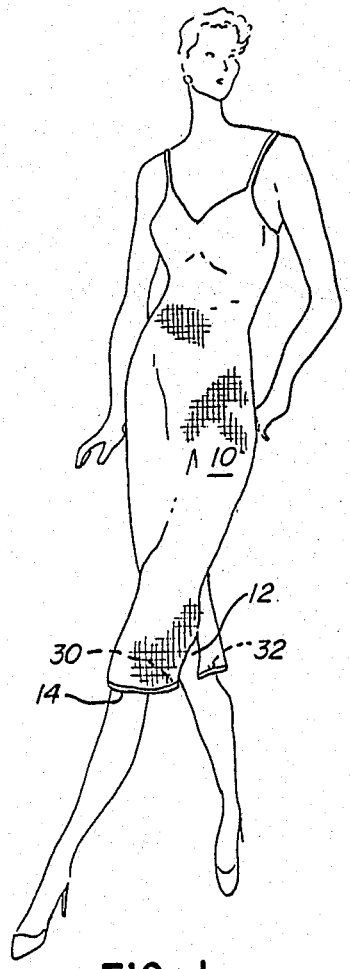
FIG. 1 is a perspective view showing the slip of the present invention as a full slip shown on a woman with one V-shaped cut-out visible.
Figure 3:
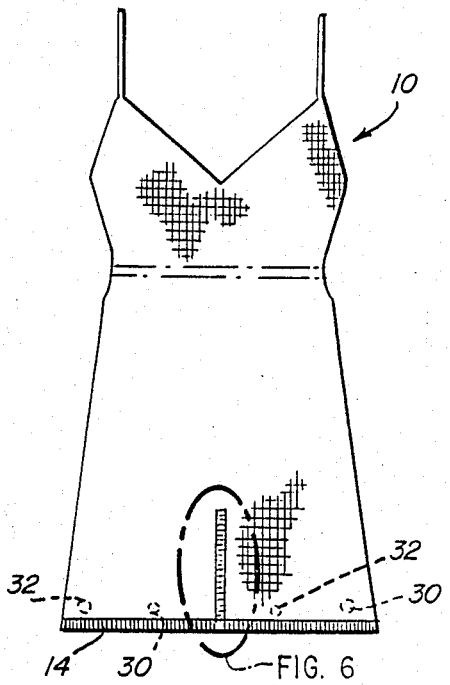
FIG. 3 is a plan view showing a full slip of the present inventoin with the V-shaped opening closed off by the closure pieces of the invention.
Figure 6:
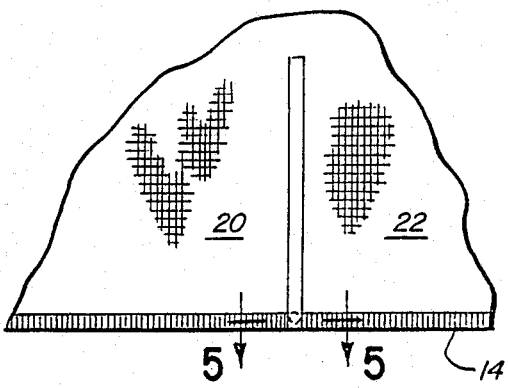
FIG. 6 is a detailed view showing the V-shaped opening closed off by the closure pieces.
Figure 4:
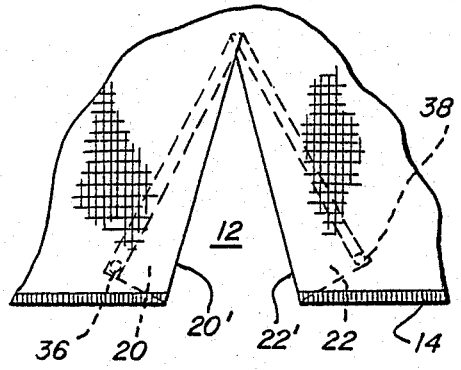
FIG. 4 is an enlarged, detailed view of the portion of the slip having the V-shaped opening, with the closure elements shown snapped back in their V-shaped opening exposure state.
Figure 5:
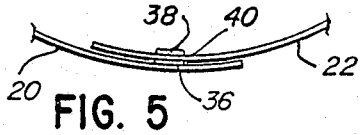
FIG. 5 is a detailed view of the male and female fastening elements provided on the overlapping portions of the closure pieces.

Referring now to the drawing in greater detail, the slip according to the present invention is indicated generally by reference numeral 10. In the form of the invention indicated in FIGS. 1 and 3, a full slip is provided, and includes in the preferred embodiment four V-shaped cut-outs or openings 12 spaced 90 angular degrees apart about the lower hem-portion 14 of the slip. The provision of four V-shaped openings allows for four different possible locations of a slit or slits in an overgarment, such as a dress or skirt. Each V-shaped opening 12 is provided with a pair of fabric closure-pieces 20 and 22, each of which is preferably triangular in shape, to form a substantially right-angle triangle, as clearly shown in FIG. 4. Each V-shaped opening 12 is a substantially isosceles-shaped triangular cut-out, so that, when the two closure-pieces 20 and 22 are in their swung out positions shown in solid in FIG. 6, the opening 12 is substantially completely closed off by the two pieces 20, 22. Each fabric closure-piece 20 and 22 has a side 20' and 22', respectively, thereof, which side forms the hypotenuse of the right-angle thereof, which is pivotal relative to the lower portion of the slip to which it is connected, so that each piece 20,22 may be alternatively swung inwardly to expose or open up the respective V-shaped cut-out, and to alternatively be swung outwardly to close off the cut-out. To keep the two pieces 20,22 in each of its two positions, a plurality of male and female fastening elements are provided. A pair of female fastening elements 30 and 32 are provided for each V-shaped opening, the fastening element 30 being provided on the interior of the lower skirt-portion of the slip adjacent the V-shaped opening near the piece 20, the interior surface being defined as that facing inwardly when the closure-pieces are in their closure positions for closing off the respective V-shaped opening, while the other female fastening element 32 is provided on the interior of the skirt-portion of the slip adjacent the V-shaped opening near the piece 22. The fabric closure-piece 20 has an inwardly-facing male fastening element 36 for cooperation with the female element 30 when the piece 20 is swung inwardly to expose the V-shaped cut-out 12, and to hold the piece 20 in that swung-in position. The piece 22 also has an inwardly-facing male fastening element 38 on the inner face thereof for cooperation with the female fastening element 32, for holding the piece 22 in its inwardly-swung position to expose the associated V-shaped cut-out. The fabric closure-piece 22 also is provided with an outwardly-facing female fastening element 40 on its outer surface thereof, at the lower regions thereof, best seen in FIG. 5, for mating engagement with the male element 36 when the two pieces 20 and 22 are swung outwardly to close off the corresponding V-shaped opening 12, to thus keep the two pieces in their outward, closing positions, It may, therefore, be seen that when the two closure-pieces 20 and 22 are in their closing-off position, they meet to close off the V-shaped opening and remain in that state as long as the male element 36 is received in the female element of the piece 22. As shown in the drawing, the piece 20 substantially overlaps the piece 22 along the vertical sides thereof, which vertical sides are substantially positioned in the center of the V-shaped opening along the height dimension thereof. The male element 36 is provided on the overlapping portion of the closure-piece 20, while the female element of the piece 22 is included on the overlapped portion thereof. Each closure-piece 20, 22 is preferably hemmed along the lower, short-side thereof, so as to give a finished appearance, and for blending in with the lower hem portion of the slip.

Figure 2:
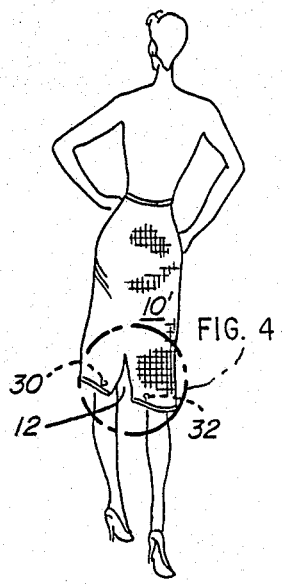
FIG. 2 is a perspective view showing a half-slip of the present invention worn by a women in which the rear, V-shaped cut-out is visible.

The invention may also be embodied in a half-slip 10', shown in FIG. 2., in which case only one V-shaped cut-out 12 and associated closure-pieces 20, 22 need be provided, since a half-slip may be rotated a full 360 degrees, so that the V-shaped opening 12 may be aligned with the slit of the skirt or dress. If the half-slip is to be used with a skirt of dress having more than one slit, then a plurality of V-shaped openings 12 and associated closure-pieces may be provided, as in the full-slip of FIG. 1. Typically, for the half-slip, only two V-shaped openings 12 and associated closure-pieces 20 and 22 are needed, and spaced 180 angular degrees apart.

The closure pieces 20 and 22 may be made of the same material as the remainder of the slip, such as nylon tricot fabric, with the entire slip being made from one pattern, cut and sewn to size and finish. In this case, the fabric closure elements 20 and 22, would each be half of the V-shaped opening. Since slip material is inherently elastic, it is a simple step to cause the overlapping of the two elements for the closing off the V-shaped opening. Further, more than one male fastening element 36 may be provided for the closure element 20, which would spaced along the length of the overlapping portion of the element 20. Likewise, a plurality of male-female fastening elements of the overlapped portion of the closure element 22 may be provided for cooperation with the plurality of male elements 36. Also, a plurality of female fastening elements 30 and 32 would similarly be provided for the male elements 36 and 38. The closure elements 20 and 22 are preferably made of lace fabric, cut and sewn to the adjoining portions of the lower skirt portion formed by the side of the V-shaped opening. Each male fastening element of the closure piece is preferably made of a plastic snap, approximately six mm. at its base, having a projecting pin of approximately three mm. in diameter with a slightly enlarged outer head portion for snapping into a mating female opening. Each female fastening element also has a base of approximately six mm., and a hole slighly less than the enlarged outer head portion so that the pin may snap therein and hold fast the two elements. Each fastening element is sewn to the respective portions of the closure pieces and skirt portion, in a conventional manner.

While a specific embodiment of the invention has been shown and described, it is to be understood that numerous changes, modifications, and adaptations may be made without departing from the scope and spirit of the invention, as set out in the appended claims. It is to be understood that the triangular shapes referred to above are only for describing the invention. All triangular shaped mentioned herein are meant to include straight sides thereof, curved sides thereof, or any other combinations thereof for aesthetic purposes. Further, it is also within the purview of the present invention to include within the terminology of the V-shaped opening, may opening performing a similar function regardless of the shape thereof. Similarly, the shapes of the closure pieces are not limited to any defined and specific shape, it being understood that the shapes described therein are only for purposes of describing the best mode for carrying out the invention, are is not to be limited thereby. It is also to be understood, that instead of two separate closure pieces 20, 22, just one closure piece may be used which would be pivotally swingable relative to the upper vertex portion of the V-shaped opening, which one closure piece would also be substantially of the same shape of the opening it is closing off.

What is claimed is:

1. In a woman's slip for use under a skirt or dress, which skirt or dress may or may not be provided with an elongated slit or slits, comprising:

a main body portion for wearing by a person from the waist downwardly, said main body portion comprising a lowermost circumferential rim portion;

the improvement comprising: at least one V-shaped cut-out having the wider portion thereof originating coplanar with said lowermost circumferential rim portion such that said wider portion divides said rim portion; said at least one V-shaped cut-out having an apex thereof spaced from said rim portion toward the waist portion of the undergarment;

and a pair of substantially triangularly-shaped closure pieces for closing off said at least one V-shaped opening and for exposed said at least one V-shaped opening when it is desired to form same, each of said pair of closure pieces having a side edge thereof formed integrally with a corresponding portion of said main body portion for pivotal movement thereat so that each said closure piece may be alternatively swung outwardly to close off said at least one V-shaped opening and alternatively swung inwardly to expose said at least one V-shaped opening; and means for fastening each of said pair of closure pieces in said outwardly-swung position and in said inwardly-swung position.

2. The improvement according to claim 1 wherein said means for fastening comprises a pair of first female fastening elements mounted to the undersurface of said main body portion on opposite sides of said at least one V-shaped opening; a first male fastening element mounted on the undersurface of one of said pair of closure pieces for mating engagement with one of said pair of first female fastening elements when said one closure piece is in said inwardly-swung position; a second male fastening element mounted on the undersurface of the other of said pair of closure pieces for mating engagement with the other of said pair of first female fastening elements; and a second female fastening element mounted on the outersurface of said other closure piece for mating engagement with said first male fastening element when said pair of closure pieces are swung into their outward positions, whereby said V-shaped cut-out may be alternatively closed off and exposed.

3. The improvement according to claim 2, comprising a plurality of said V-shaped cut-outs, and a plurality of said pair of of substantially triangularly-shaped closure pieces, one said pair for each of said plurality of V-shaped cut-outs; and a plurality of means for fastening, one said means for fastening for each of said plurality of V-shaped openings.

4. The improvement according to claim 3 wherein each said closure piece is made of lace fabric.

5. The imrprovement according to claim 4, wherein said one of said pair of closure pieces overlaps said other of said pair of closure pieces when said pair of closure pieces are in their outward positions to close off said V-shaped opening; said first male fastening element being mounted to said overlapping portion of said one of said pair of closure pieces.

6. The improvement according to claim 5, wherein said V-shaped opening is a substantially isosceles triangle, with the equal sides thereof extending from said rim portion of said main body portion upwardly toward the waist portion thereof.

7. The improvement according to claim 6,wherein each of said pair of closure pieces comprises a fabric in the shape of a right-angle triangle, the hypotenuse thereof being formed at the side thereof forming the line about which the respective closure piece swings relative to said main body portion, whereby, when said pair of closure pieces are swung outwardly to close off said V-shaped cut-out, the two pieces define an isosceles -shaped triangle similar to said V-shaped cut-out to thereby close off said V-shaped cut-out.

8. The improvement according to claim 17, wherein each of said closure pieces further comprises a short-side of said right-angle triangle thereof, the length of said short-side of said one closure piece being longer than the length of the short-side of said other closure piece, to thereby define the overlapping portion of said one clousre piece, said overlapping portions of said closure pieces being defined by a leg of the right angle of each of said closure pieces, said legs lying substantially perpendicularly to the plane containing therein said rim portion of said main body portion.

9. The improvement according to claim 8, comprising a plurality of said V-shaped openings, and a plurality of said pair of substantially triangularly-shaped closure pieces, one said pair of closure pieces for one said V-shaped opening; and a plurality of means for fastening, one said means for fastening for each said plurality of V-shaped openings.

10. The improvement according to claim 9, wherein said undergarment is one of a full-slip and a half-slip.

* * * * *